United States Patent [19]

Brown

[11] 4,207,992

[45] Jun. 17, 1980

[54] TIMED MEDICINE DISPENSER

[76] Inventor: John H. Brown, 6333 Kalani, Dallas, Tex. 75240

[21] Appl. No.: 909,628

[22] Filed: May 26, 1978

[51] Int. Cl.[2] ..... B65B 59/00

[52] U.S. Cl. ..... 221/15; 221/82; 221/155

[58] Field of Search ..... 221/15, 4, 8, 243, 82, 221/86, 89; 222/70

[56] References Cited

U.S. PATENT DOCUMENTS

| | | | |
|---|---|---|---|
| 1,802,674 | 4/1931 | Schyler | 221/82 |
| 2,028,787 | 1/1936 | Lane | 221/15 |
| 2,792,147 | 5/1957 | Stewart | 221/82 |
| 3,722,739 | 3/1973 | Blumberg | 221/15 |
| 3,727,794 | 4/1973 | DiEranco | 221/82 |
| 3,815,780 | 6/1974 | Bauer | 221/15 |

*Primary Examiner*—Allen N. Knowles

*Attorney, Agent, or Firm*—Gerald G. Crutsinger; John F. Booth; Harry C. Post, III

[57] ABSTRACT

A timing mechanism for dispensing medicine on a timed basis for a patient to remind the patient to take the medication. The device comprises a dispensing wheel having a plurality of medication storage compartments, which are labeled to indicate various times of the day and days of the week to receive the medicine. The timing device comprises an electric motor which drives a gear adapted to turn a transfer gear which in turn rotates a driven gear to move the compartmented dispensing wheel one compartment per time period to dispense medicine into a hopper for use.

14 Claims, 10 Drawing Figures

TIMED MEDICINE DISPENSER

BACKGROUND OF THE INVENTION

The practice heretofore for dispensing medication to a patient has been to allow the patient to administer the medication to himself, or to have a friend of the family remind the patient to take the medicine or to have a nurse or physician administer the medication. This requires a constant notice of time and the time that the last medication was received or administration by nurses and physicians which is often costly and impractical for administration of medication within the home. This is often the case in elderly patients who frequently lose track of time because they are often alone and unaware of the passage of time or may be mentally confused due to a given health problem or illness.

One of the major problems encountered when the patient administers his own medication is that an under dosage or over dosage frequently is received by the patient or the medication is received at the wrong time which can have a harmful effect or be totally ineffective. This is often the case in elderly patients who frequently lose track of time because they are often alone and unaware of the passage of time.

Also, it is felt that controlled dispensing of medication in such a manner as described could greatly lessen or prevent fatalities occurring from drug overdose, suicide, and unintentional overdose while under the influence of alcoholic beverages, other drugs, or hallucinogens.

It is also desirable to control the use of certain medications to prevent unauthorized use by children or others of harmful drugs.

Devices heretofore used for periodic dispensing medicine have generally been of a complex nature making it difficult for the average elderly patient to place his medicine within the machine such as those disclosed in U.S. Pat. No. 3,815,780 which disclose numerous cams for turning a dispensing wheel which is not readily accessible to the patient for filling the wheel with medicine.

Other devices include manual devices for individual tablet dispensing such as that disclosed in U.S. Pat. No. 3,743,085 which depends upon the memory of the patient for turning the wheel to dispense the medication.

Other similar devices are disclosed in U.S. Pat. No. 3,727,794 which is an automatic reminder dispensing device for dispensing memorandums and not tablets.

SUMMARY

I have devised a simple device which is capable of holding a week's supply of medication and dispensing it at timed increments during the day to remind the patient to take same. The device generally comprises a dispensing wheel having a plurality of compartments corresponding to timed increments during the day for each day of the week or other desirable time period.

The driving mechanism comprises a synchronous electric motor secured to a drive gear, the motor is adapted to rotate the drive gear one revolution per day. The drive gear has four sets of teeth equally spaced about 180 degrees the outer periphery of the drive gear adapted to rotate a four-tooth transfer gear. The transfer gear is adapted to incrementally rotate a drive gear such that rotation of the transfer gear moves the driven gear to move the attached compartmented dispensing wheel one compartment.

The compartments are arranged such that the compartment for a single time period is aligned with a passage formed in the lower portion of the device such that the medication falls from the compartment through the passage into a hopper for the patient.

A primary object of the invention is to provide a device for dispensing medication on a timed basis daily for as long as a week.

A further object of the invention is to prevent the unauthorized consumption by children or others of drugs which may be hazardous to one's health when taken without the aid of a physician.

A further object of the invention is to provide a dispenser for "as required" medication; that is for "as needed" medication but which must not be taken more often than prescribed.

A further object of the invention is to provide medication dispensing for those patients in hospitals, nursing homes, clinics, and the like, to minimize labor costs and time spent dispensing drugs; and which may be key or coin operated for vending or other purposes.

A further object of the invention is to provide a device which maximizes accuracy of medication taken by deaf or blind through the use of audio or visual signals; and which could be used by the arthritic or handicapped, unable to open bottles or medication containers.

A further object of the invention is to provide a device for dispensing medication instructions, reminders for other prescribed treatments (i.e. physical therapy, cough syrup, moist heat, liniment, enema, etc.), or physician follow-up messages can be dispensed.

A further object is the dispensing for fish, plants, birds, and animals to increase commercial yield or reproductivity and to assure proper and regular nutrients during periods of absence or inclement weather.

A still further object of the invention is to provide a device which will remaind persons on medication to take the medication at the proper time and in the proper sequence to maximize the results of the medication.

A still further object of the invention is to provide a medication dispenser which is readily accessible to the patient or other authorized persons to place the medication within the dispensing wheel for a predetermined number of days and to allow visual observation of the progress of the medication which has been dispensed.

Other and further objects of the invention will become apparent upon referring to the following detailed description and to the drawings annexed hereto.

BRIEF DESCRIPTION OF THE DRAWINGS

Drawings of a preferred embodiment of the invention are annexed hereto so that the invention may be better and more fully understood, in which.

Numeral references are employed to designate like parts throughout the various figures of the drawings.

DESCRIPTION OF A PREFERRED EMBODIMENT

Figure 1:
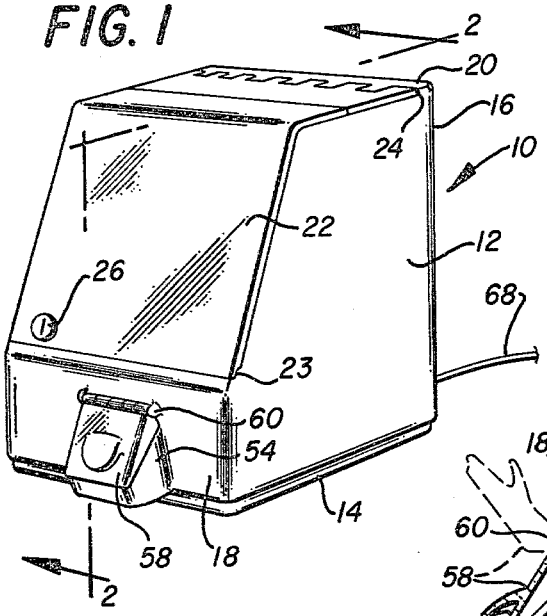
FIG. 1 is a perspective view of the dispensing cabinet.

Referring to FIG. 1, the apparatus generally comprises a cabinet 10 having a side 12, a bottom 14, a back 16, front wall 18, and top 20. Door 22 is secured to top 20 by hinge pin 24. Door 22 is preferably sloped so that any paralax problems will be avoided. Door 22 is constructed of a transparent material to allow visual inspection of the contents. Lock means such as cam lock 26 may be provided to prevent unauthorized access to the medication. A lip 23 is formed on the lower end of door 22 to engage recess 19 and front wall 18 to limit inward movement of the door 22.

A generally transverse support member 28 is positioned between the side walls 12 of the cabinet 10.

The dispensing wheel 30 generally comprises a circular disc 32 having a plurality of radially extending partitions 34 which extend upwardly from disc 32 and outwardly from upwardly extending annular ring 36. The partitions 34 divide the dispensing wheel 30 into a plurality of equally spaced compartments 38. A position indicator disc 40 may be positioned in the central area formed by ring 36 having indicia printed thereon to designate times of the day and days of the week for each compartment 38. The dispensing wheel 30 is preferably disposed at an angle such as 30°–70° from horizontal to allow the medication to be viewed easily and to facilitate the process of placing medication in the compartments 38.

The dispensing wheel 30 is rotatably secured to shaft 42 by sleeve bearing 44.

Means to maintain the medication within compartments 38 comprises an annular dish-shaped shield 46 having an outer wall 48 and bottom 50 secured to support member 28. It should be readily apparent that shield 46 prevents medication from falling from compartments as the dispensing wheel 30 rotates about shaft 42. A passage 52 is formed in shield 46 on the lower portion thereof which communicates with a cup-shaped dispensing hopper 54 which communicates with a passage 56 formed in front wall 18. A door 58 constructed of transparent material is pivotally secured by pin 60 to front wall 18 to allow access to the cup-shaped hopper 54. As the dispensing wheel 30 rotates, the medication shown in phantom outline (FIG. 3) designated M falls from the compartments 38 into the hopper 54 to allow access by the patient to the medication M.

Figure 3:
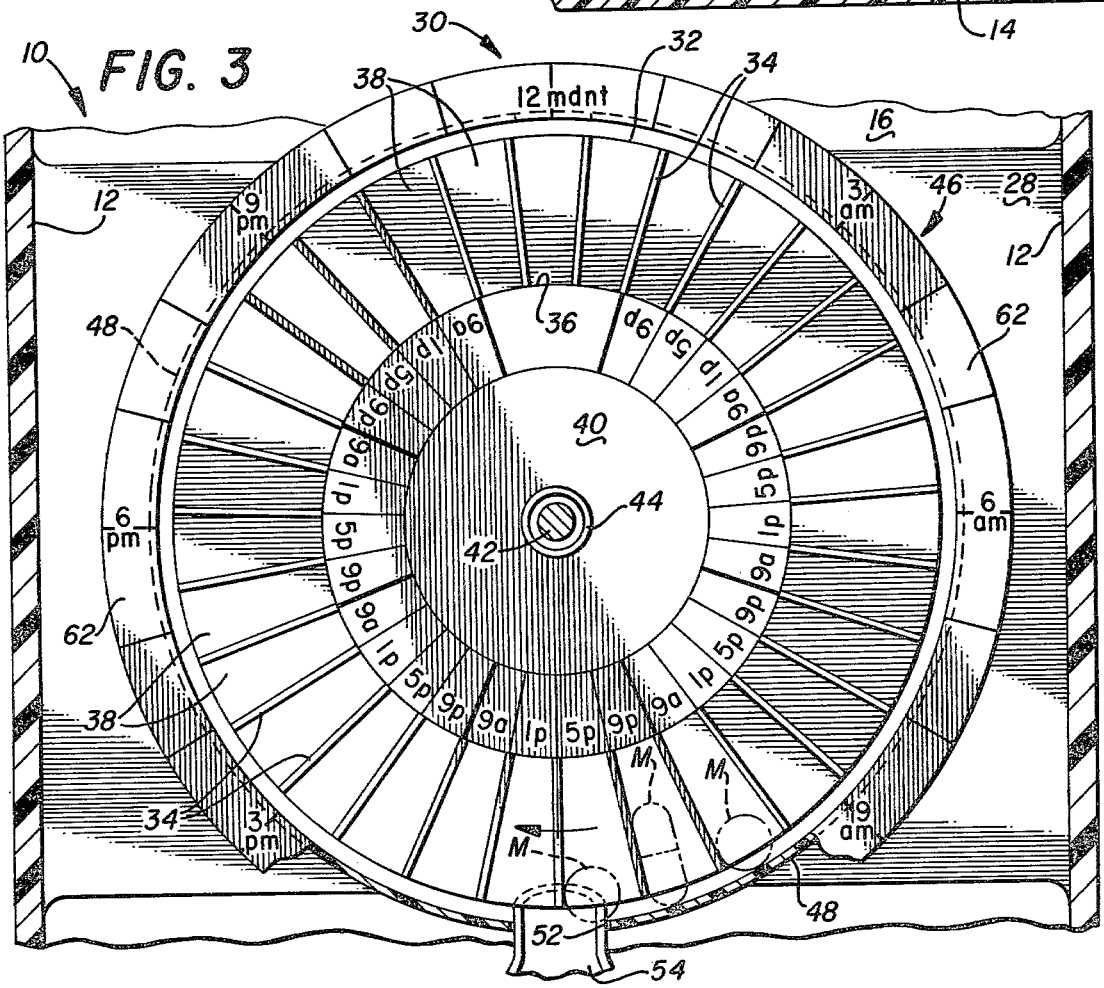
FIG. 3 is a cross-sectional view taken along line 3—3 of FIG. 2 and slightly enlarged to further show details.

The shield 46 has an outer flange 62 formed on the upper side thereof which has indicia printed thereon indicating the hours on a 24 hour clock with 12 midnight being formed in the 12 o'clock position as shown in FIG. 3 and 12 noon at the six o'clock position as illustrated in FIG. 3.

Shaft 42 extends downwardly and through support 28 and is secured to drive means, such as motor 64, which is secured to the underside of support 28 by screws 66. Synchronous motor 64 is preferably electric and is connected by lines 68 to a source of power (not shown).

Figure 2:
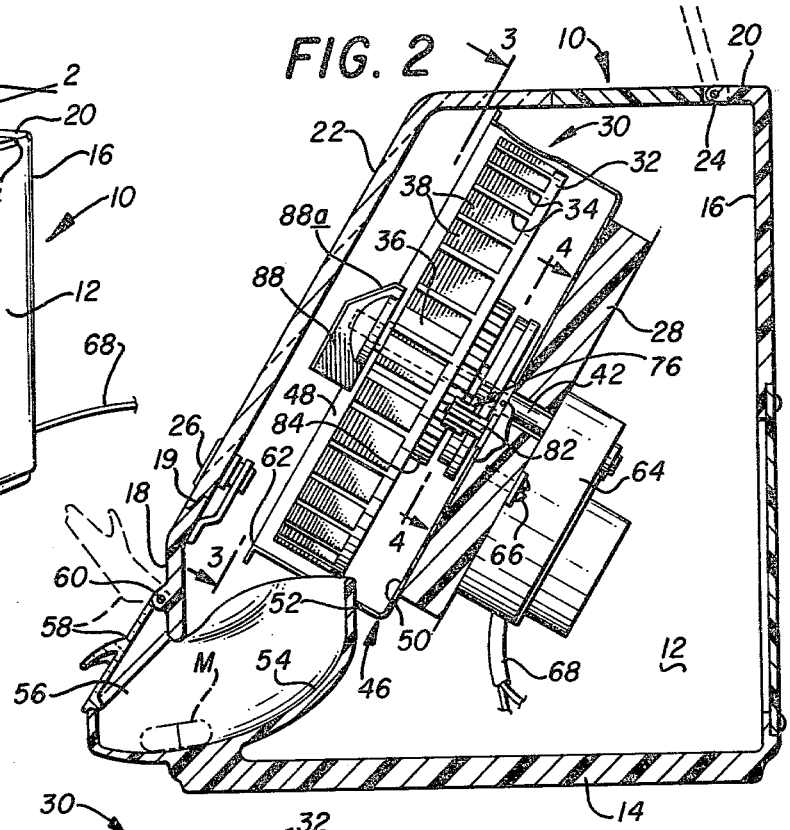
FIG. 2 is a cross-sectional view taken along line 2—2 of FIG. 1.
Figure 4:
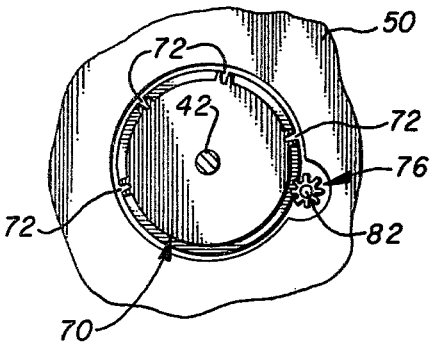
FIG. 4 is a cross-sectional view taken along line 4—4 of FIG. 2.
Figure 5:
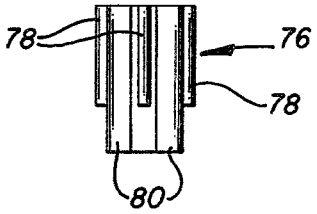
FIG. 5 is an enlarged elevational view of the transfer gear.
Figure 6:
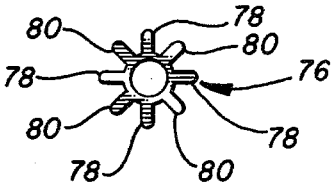
FIG. 6 is a plan view of the transfer gear.
Figure 8:
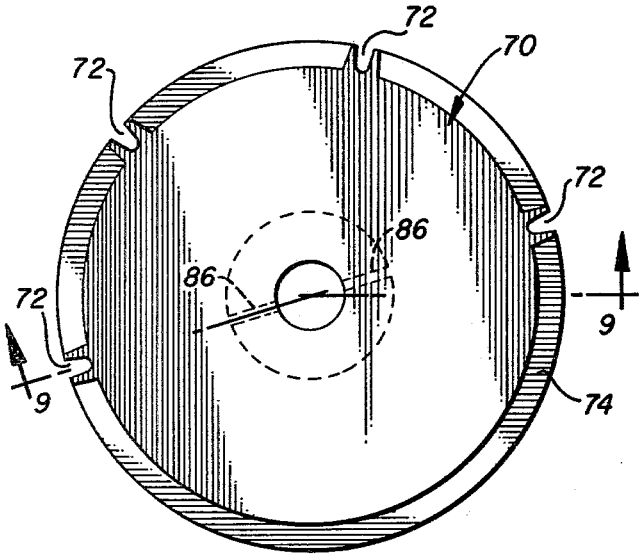
FIG. 8 is an enlarged plan view of the drive gear.
Figure 7:
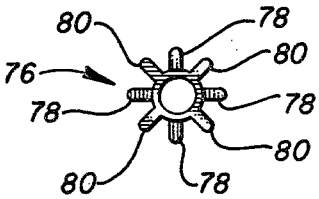
FIG. 7 is a bottom plan view of the transfer gear.

As best illustrated in FIGS. 2 and 4, shaft 42 is rigidly secured to a driving gear 70. As best illustrated in FIG. 8, driving gear 70 comprises a circular gear having four teeth 72 equally spaced over one-half the circumference of gear 70 and above flange 74. A transfer gear 76, as best illustrated in FIGS. 2, and 4–7, generally comprises a cylindrical shaped gear 76 having four teeth 78 equally spaced about the gear on the upper portion and four other teeth 80 which extend the length of gear 76 which engage teeth 72 on driving gear 70. Transfer gear 76 is rotatably supported on stub shaft 82 secured to the upper surface of support member 28. The upper portion of transfer gear 76 is adapted to engage driven gear 84 as best illustrated in FIG. 2 which is rigidly secured to the lower surface of disc 32 dispensing wheel 30. Since only four teeth of transfer gear 76 engage the teeth 72 on driving wheel 70, each tooth 72 turns transfer gear 76 ninety degrees, allowing a pair of teeth 78 and 80 to rotate driven gear 84 to rotate dispensing wheel 30 one compartment 38 to position the next compartment over hopper 54 to allow any medication within that compartment to pass through passage 52 to the hopper 54.

Figure 9:
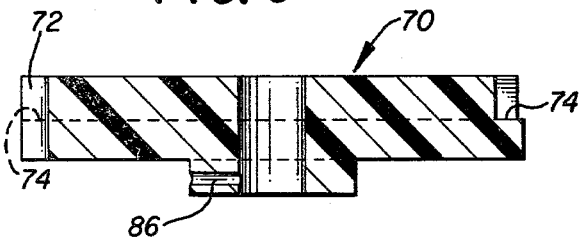
FIG. 9 is a cross-sectional view taken along line 9—9 of FIG. 8.

It should be readily apparent from FIG. 9 that the ledge 74 passes under teeth 78 and 80 such that no rotation of gear 76 occurs except in the four positions of teeth 72.

Driving gear 70 is rigidly secured to shaft 42 by a pin passing through passage 86.

A pointer knob 88 having a point 88*a* is secured to the outer end of shaft 42 to set the position of motor 64 at the proper time as indicated on flange 62.

Operation of the hereinbefore described device is as follows:

A line cord 68 is inserted in a power outlet such as a 110 volt AC outlet. The unit is set by lifting door 22 and grasping the knob 88 and turning it until 88*a* points to the time indicated on the outer flange 62 corresponding to that time of day. The medication M is positioned in compartments 38 corresponding to the time of the day at which they are supposed to be taken.

The mechanism then rotates such that four of the compartments 38 per day pass the opening 52 to drop the medication contained therein into the hooper 54. The dispensing wheel 30, illustrate in FIG. 3, is capable of having medicine for seven days such that a weeks supply may be placed into the dispensing wheel 30. This is based on a regular day of from 9:00 am to 9:00 pm and assumes that most medicine is taken four times a day during the day. More than one capsule may be placed in a compartment 38 if more than one medication is being taken. If it is necessary to take medication at night then more teeth 72 could be added to driving gear 70 and the indicator disc 40 could be amended to show 1:00 am and 5:00 am for additional medication receiving times.

Once the medication is dropped into the hopper 54, door 58 is raised and the medication may be taken as prescribed. The cabinet 10 may be placed next to the bedside or in a location easily accessible to the patient.

MODIFIED EMBODIMENT

Figure 10:
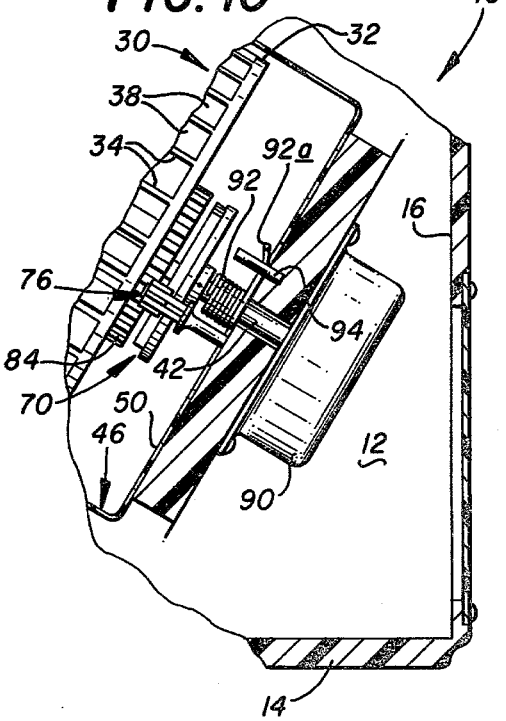
FIG. 10 is an alternate embodiment of the drive mechanism showing a spring wound motor.

As illustrated in FIG. 10, if an electrical power drive means is undesirable or unobtainable, a spring wound motor 90 may be secured to shaft 42. A spring clutch 92 is secured to shaft 42 having an end 92*a* which is urged against pin 94 to allow rotation of shaft 42 by knob 88 to wind motor 90. By grasping the pointer 88, the motor 90 may be wound up to run the device for up to seven days. Clutch 92 releases dispensing wheel 30 until the timing motor 90 unwinds. The remaining structure is as heretofore described such that rotation of shaft 42 rotates the driving gear 70 to rotate the transfer gear 76 to rotate driven gear 84 to rotate the dispensing wheel 30.

This modified embodiment is particularly adaptable to the "as required" dispensing. For instance, with a four-hour spring motor, the unit will not operate more often than four hours. The transfer gear 70 has only two teeth 72 and will only dispense one time as the knob 88 is rotated 360 degrees. It will not be in position to dispense again until the spring motor unwinds one revolution.

It should be readily apparent from the foregoing that each of the embodiments hereinbefore described accomplishes the objects of the invention hereinbefore discussed.

It should be appreciated that other and further embodiments of the invention may be devised without departing from the basic concept herein described.

Having described my invention, I claim:

1. A medication dispensing device for dispensing medication at timed intervals over a predetermined period of time, comprising: a cabinet; a hopper supported within said cabinet; a shaft rotatably supported in said cabinet; a dispensing wheel rotatably supported by said shaft having a plurality of compartments with each compartment having an opening on the outer edge of the wheel; means to rotate said shaft one revolution per the predetermined period of time; a driven gear for rotating said dispensing wheel positioned around said shaft; a driving gear secured to said shaft having teeth spaced about its periphery by intervals sufficient for the opening of each compartment to be registered with an opening into the hopper at each timed interval; a transfer gear rotatably secured in said cabinet, a portion of the transfer gear positioned to engage said driven gear and another portion of the transfer gear positioned to engage the teeth of the driving gear at the timed intervals which rotates said dispensing wheel and register a compartment with the hopper and thereby dispense medication at the timed intervals over the predetermined period of time.

2. The combination called for in claim 1 wherein said cabinet comprises; an enclosure having a side with an opening therein; and a transparent door secured over said opening to allow viewing of medication in the dispensing wheel.

3. The combination called for in claim 2 wherein the side of the enclosure which includes the opening is disposed at an angular position to allow viewing of the medication.

4. The combination called for in claim 1 wherein said dispensing wheel comprises: a disc concentrically supported about said shaft; and a plurality of radially extending partitions extending outwardly from said shaft for forming said compartments.

5. The combination called for in claim 1 wherein said dispensing wheel is disposed at an angle to the cabinet bottom to facilitate viewing of medication.

6. The combination called for in claim 1 wherein said means to drive said shaft comprises: an electric motor supported in said cabinet.

7. The combination called for in claim 1 wherein said driving gear has four teeth equally spaced about one-half its periphery for rotating the transfer gear at the timed intervals.

8. The combination called for in claim 1 with the addition of: a shield disposed within said cabinet adjacent to said dispensing wheel adapted to prevent medication from falling out of said compartments.

9. The combination called for in claim 8 wherein said hopper is formed in the bottom portion of the front wall of said cabinet and is communicating with an opening formed in said shield such that as a compartment passes the opening in the shield the medication from the compartment falls into the hopper.

10. The combination called for in claim 1 wherein said means to drive said shaft comprises: a spring wound motor supported in said cabinet.

11. The combination called for in claim 1 wherein said means to drive said shaft is adapted to be reset before rotating said shaft for dispensing more medication.

12. A medication dispensing device for dispensing medication at timed intervals over a predetermined period of time, comprising: a cabinet having a bottom, a front wall with a portion of the wall angularly disposed, an opening through the angularly disposed portion of the front wall, and a transparent door secured to the front wall to cover said opening while permitting viewing of the medication within said cabinet; a hopper formed in the front bottom portion of said cabinet to permit access to the dispensed medication; a dispensing wheel having a disc and a plurality of radially extending partitions forming compartments to receive the medication to be dispensed at each timed interval, each compartment being open on the outer edge of the disc; a shield adapted to prevent the medication from falling out of the compartments having an opening disposed in the shield so that as a compartment passes the opening the medication falls into the hopper; a shaft concentrically supporting the disc of said dispensing wheel rotatably supported in said cabinet; means to rotate said shaft one revolution per the predetermined period of time and adapted to reset before rotating said shaft; a driving gear secured to said shaft having four teeth equally spaced about one-half the periphery of the driving gear; a segmented transfer gear for engaging the teeth on said driving gear rotatably secured adjacent to said driving gear; a driven gear secured to said dispensing wheel and rotatably positioned around said shaft, said driven gear engaging said transfer gear such that rotation of said transfer gear at the timed intervals causes said driven gear and dispensing wheel to rotate which dispenses medication from the compartments into the hopper at the timed intervals over the predetermined period of time.

13. The combination called for in claim 12, wherein said means to drive said shaft comprises an electricmotor supported in said cabinet.

14. The combination called for in claim 13, wherein said means to drive said shaft comprises a spring motor supported in said cabinet.

* * * * *